US006105766A

United States Patent [19]

Chuang

[11] Patent Number: 6,105,766

[45] Date of Patent: Aug. 22, 2000

[54] SUSPENSION BASED FASTENING DEVICE FOR ATTACHE CASE

[76] Inventor: Yao-Tang Chuang, P.O. Box 82-144, Taipei, Taiwan

[21] Appl. No.: 09/472,802

[22] Filed: Dec. 28, 1999

[51] Int. Cl.[7] ..... B65D 85/30

[52] U.S. Cl. ..... 206/320; 206/583; 24/301

[58] Field of Search ..... 206/320, 576, 206/583, 305, 805; 190/124, 125; 24/300, 301, 265 H, 265 R

[56] References Cited

U.S. PATENT DOCUMENTS

| | | | |
|---|---|---|---|
| 5,160,001 | 11/1992 | Marceau | 206/320 |
| 5,217,119 | 6/1993 | Hollingsworth | 206/583 |
| 5,402,557 | 4/1995 | Dalen | 24/301 |
| 5,524,754 | 6/1996 | Hollingsworth | 206/583 |
| 5,529,184 | 6/1996 | Sadow | 206/320 |
| 5,611,119 | 3/1997 | Allen | 24/301 |
| 5,725,090 | 3/1998 | Vermillion et al. | 206/320 |
| 5,857,568 | 1/1999 | Speirs | 206/320 |

FOREIGN PATENT DOCUMENTS

| | | | |
|---|---|---|---|
| 2181345 | 4/1987 | United Kingdom | 24/301 |

*Primary Examiner*—David T. Fidei
*Assistant Examiner*—Luan K. Bui
*Attorney, Agent, or Firm*—A & J

[57] ABSTRACT

A fastening device for attache case comprises a fracture resistant frame and a longer and shorter straps adjacent either side of the frame. The shorter strap comprises antiskid stripes and an end Velcro-type fastener. The longer strap comprises antiskid stripes, an end mating Velcro-type fastener, and an elastic band stitched to the bottom of antiskid stripes. Further, an elastic strip is formed across of elastic band. With this, a portable personal computer wrapped around by straps is secured when the case is unbalanced. Even in a falling condition of the case, the computer is still free from direct collision to the bottom of attache case due to the elastic support of straps, the maximum extension of elastic band, and the extension of elastic strip.

3 Claims, 4 Drawing Sheets

SUSPENSION BASED FASTENING DEVICE FOR ATTACHE CASE

FIELD OF THE INVENTION

The present invention relates to luggage and more particularly to a suspension based fastening device for attache case for preventing a portable personal computer stored therein from damage because attache case is slanted or fallen.

BACKGROUND OF THE INVENTION

Conventionally, a user usually uses a flight bag or hand bag to store a portable personal computer (e.g., lap top computer) to carry. But this is unsatisfactory for the purpose for which the invention is concerned for the following reason. No protective mechanism has been provided. As such, this portable personal computer may be damaged due to collision with the frame when the attache case is not in a horizontal position. To the worse, this portable personal computer may malfunction when the bag falls on the ground heavily. Thus, it is desirable to provide an improved attache case in order to overcome the above drawbacks of prior art.

SUMMARY OF THE INVENTION

It is an object of the present invention to provide a suspension based fastening device for attache case comprising a fracture resistant frame and a longer strap and a shorter strap provided adjacent either side of the frame longitudinally extended from top frame. The shorter strap comprises antiskid stripes and a Velcro-type fastener. The longer strap comprises antiskid stripes at the upper portion, a mating Velcro-type fastener at the lower portion, and an elastic band stitched to the bottom of antiskid stripes. Further, an elastic strip is formed across two ends of elastic band. With this, a portable personal computer wrapped around by straps is secured together when attache case is in an unbalanced condition. Even in a falling condition of attache case, the portable personal computer is still free from direct collision to the bottom of attache case due to the elastic support of straps, the maximum extension of elastic band, and the extension of elastic strip.

The above and other objects, features and advantages of the present invention will become apparent from the following detailed description taken with the accompanying drawings.

DETAILED DESCRIPTION OF THE PREFERRED EMBODIMENTS

Figure 1:
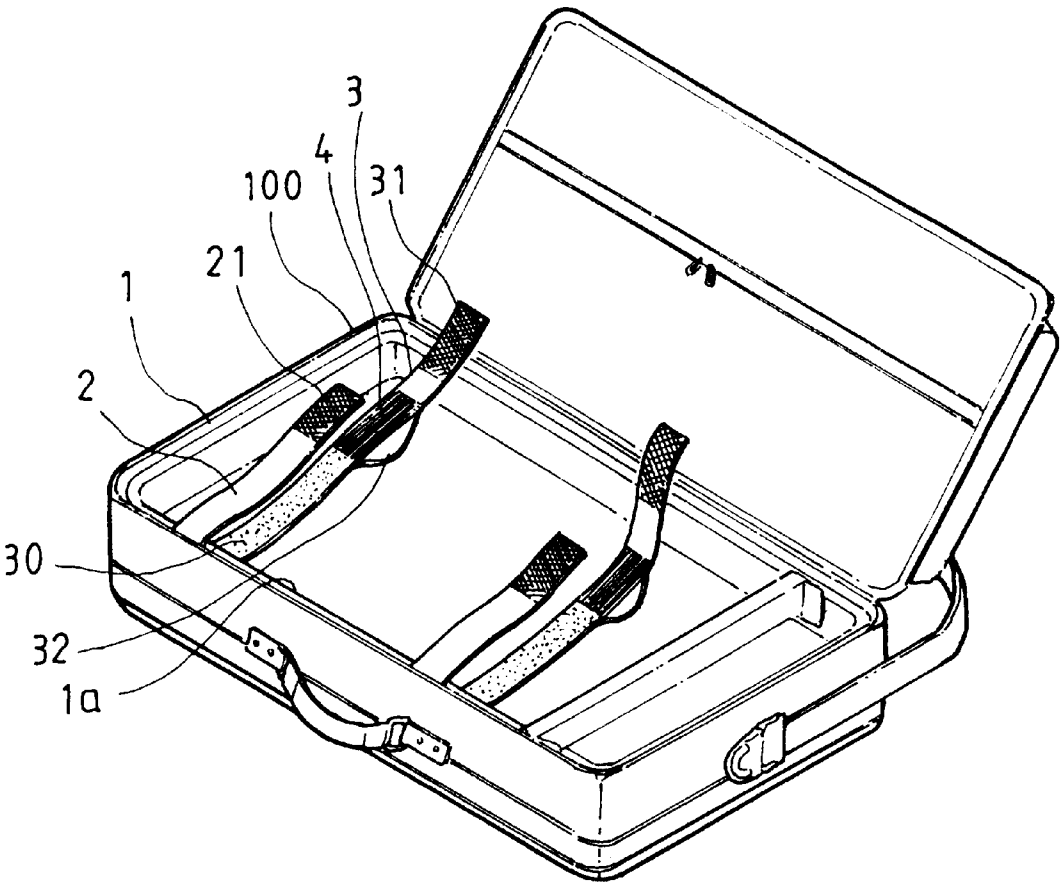
FIG. 1 is a perspective view of a preferred embodiment of a suspension based fastening device for attache case of the invention, where the cover is open to reveal certain internal features of the invention.

Referring to FIG. 1, there is shown a suspension based fastening device for attache case constructed in accordance with the invention. The attache case 100 has a frame 1 made of fracture resistant thermoplastic. A longer strap 2 and a shorter strap 3 are provided adjacent either side of frame 1 longitudinally extended from top frame 1*a*. Strap 2 comprises a predetermined length of antiskid stripes 20 (not shown) and a Velcro-type fastener 21. Similarly, strap 3 comprises a predetermined length of antiskid stripes 30 at the upper portion, a mating Velcro-type fastener 31 at the lower portion, and an elastic band 4 stitched to the bottom of antiskid stripes 30 wherein an elastic strip 32 is formed across two ends of elastic band 4, i.e., located in the overlap between strap 3 and elastic band 4.

Figure 2:
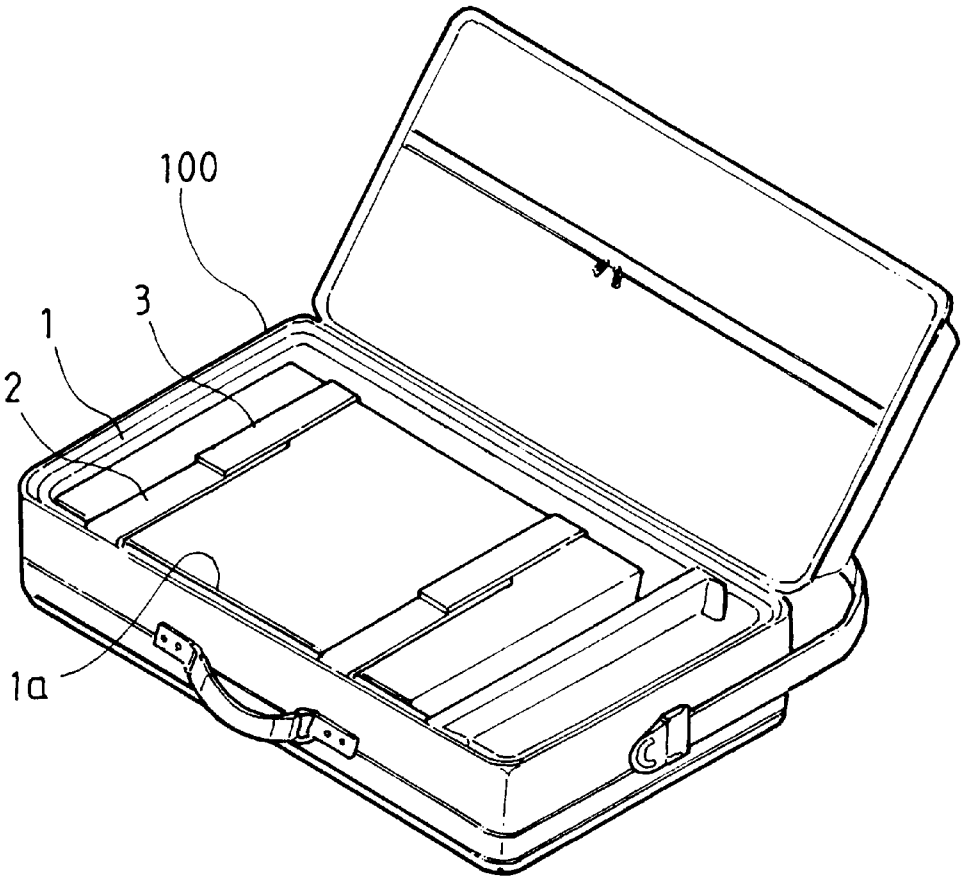
FIG. 2 is similar to FIG. 1, where a portable personal computer is fastened by the device of the invention.

Referring to FIG. 2 the fastening of portable personal computer 5 to attache case 100 is illustrated. First put portable personal computer 5 on the straps 3, while the straps 2 place on portable personal computer 5. Then press mating Velcro-type fastener 31 on Velcro-type fastener 21 to secure portable personal computer 5. As a result, portable personal computer 5 is suspensively secured to straps 2 and 3 in the attache case 100.

Figure 3:
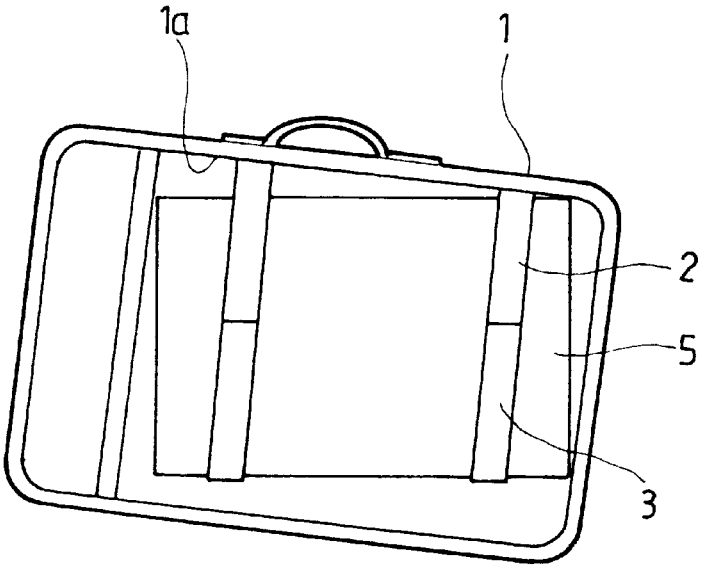
FIGS. 3 and 4 are two environmental views illustrate attache case unbalanced conditions occurred.
Figure 4:
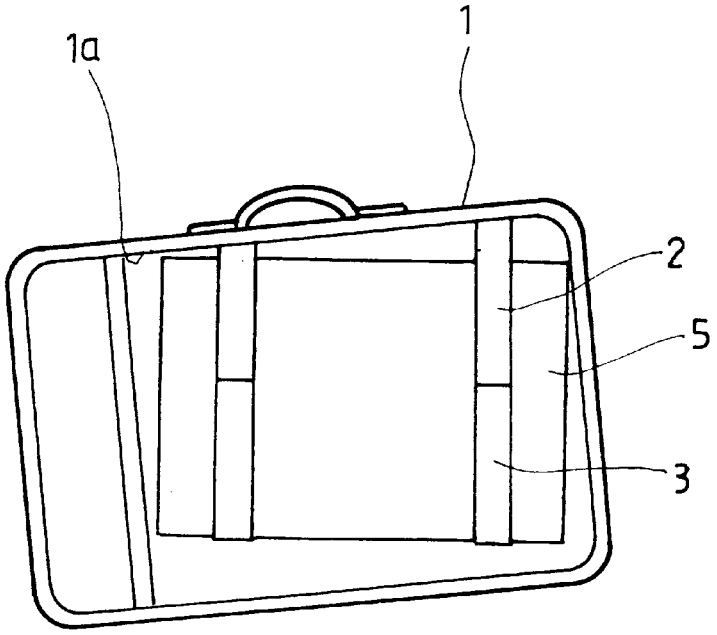

Referring to FIGS. 3 and 4, it is seen that portable personal computer 5 simply collides with top frame 1*a* when an unbalanced condition occurred due to the support and fastening of straps 2 and 3. In other words, no sliding or heavy collision occurs to portable personal computer 5 stored in attache case 100.

Figure 5:
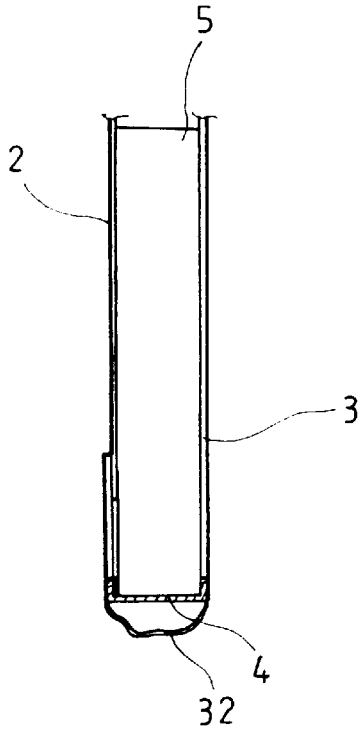
FIGS. 5 and 6 are two environmental views illustrate attache case falling conditions occurred.
Figure 6:
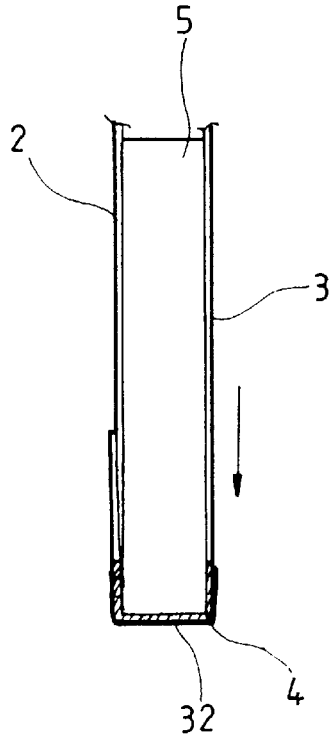

Referring to FIGS. 5 and 6, a detailed description of attache case 100 inadvertently falling on ground is as follows. In a minor falling, portable personal computer 5 is free from direct collision to the bottom of attache case 100 due to the elastic support of straps 2, 3 and the extension of elastic band 4 in the bottom of the portable personal computer 5. Even in a heavy falling, portable personal computer 5 is still free from direct collision to the bottom of attache case 100 due to the elastic support of straps 2, 3, the maximum extension of elastic band 4, and the maximum extension of elastic strip 32. The principle implemented by the invention is the same as so called "Bungee Jumping".

While the invention herein disclosed has been described by means of specific embodiments, numerous modifications and variations could be made thereto by those skilled in the art without departing from the scope and spirit of the invention set forth in the claims.

What is claimed is:

1. A suspension based fastening device for an attache case comprising:

a fracture resistant frame; and a first strap and a second strap shorter than the first strap provided adjacent either side of the frame longitudinally extended from the top of the frame wherein the first strap has a mating Velcro-type fastener, an elastic band, and an elastic strip formed across two ends of the elastic band and the second strap has a Velcro-type fastener, whereby a portable personal computer wrapped around by pressing the mating Velcro-type fastener on the Velcro-type fastener is secured and free from direct collision to the bottom of the attache case when the attache case is in one of unbalanced and falling conditions.

2. The fastening device of claim 1, wherein the mating Velcro-type fastener is in the open end of the first strap and the Velcro-type fastener is in the open end of the second strap.

3. The fastening device of claim 1, wherein each of the straps further comprising a portion of antiskid stripes.

* * * * *